US005394630A

United States Patent [19]

Moinat

[11] Patent Number: 5,394,630

[45] Date of Patent: Mar. 7, 1995

[54] DEVICE FOR MOUNTING A TOOL AT THE END OF A CONSTRUCTION-MACHINE JIB

[76] Inventor: Etienne Moinat, En Chateau-Neuf, Monnaz, Switzerland, 1125

[21] Appl. No.: 174,383

[22] Filed: Dec. 27, 1993

Related U.S. Application Data

[63] Continuation-in-part of Ser. No. 700,490, May 15, 1991, abandoned, and a continuation-in-part of Ser. No. 906,831, Jun. 30, 1992, abandoned.

[30] Foreign Application Priority Data

| | | | |
|---|---|---|---|
| Jul. 18, 1990 | [CH] | Switzerland | 2388/90 |
| Jul. 9, 1991 | [EP] | European Pat. Off. | 91810540 |
| Mar. 10, 1992 | [CH] | Switzerland | 777/92 |
| Jan. 26, 1993 | [CH] | Switzerland | 226/93 |

[51] Int. Cl.[6] ..... E02F 3/76; A01B 51/00

[52] U.S. Cl. ..... 37/468; 37/231; 414/723; 172/272

[58] Field of Search ..... 37/468, 231, 103, 113 R; 172/272, 273, 275; 403/405.1, 373; 414/723, 912; 411/396, 15

[56] References Cited

U.S. PATENT DOCUMENTS

| | | | |
|---|---|---|---|
| 3,512,665 | 5/1970 | Westendorf | 414/723 |
| 3,556,323 | 1/1971 | Heimmermann | 37/468 |
| 3,794,195 | 2/1974 | Clerenger et al. | 414/723 |
| 4,030,624 | 6/1977 | Matthews | 172/272 |
| 4,480,955 | 11/1984 | Andrews et al. | 414/723 |
| 4,545,720 | 10/1985 | Cochran et al. | 414/723 |
| 4,625,988 | 12/1986 | Witchey et al. | 37/468 |
| 4,663,866 | 5/1987 | Karlsson et al. | 414/723 |
| 5,098,252 | 3/1992 | Sleesley et al. | 414/723 |
| 5,332,353 | 7/1994 | Arnold | 37/468 |

*Primary Examiner*—Randolph A. Reese
*Assistant Examiner*—Spencer Warnick
*Attorney, Agent, or Firm*—Darby & Darby

[57] ABSTRACT

Tool mounting is effected by engagement of profiled parts of the end piece of the machine jib between a face of the tool and corresponding profiled parts of the tool. The profiled parts have ramps that are maintained in engagement by a locking mechanism exerting a transverse pressure so that the play is automatically taken up. The mounting is compact and favorable from a mechanical point of view in that the ramps, not the locking mechanism, carry the working load.

17 Claims, 12 Drawing Sheets

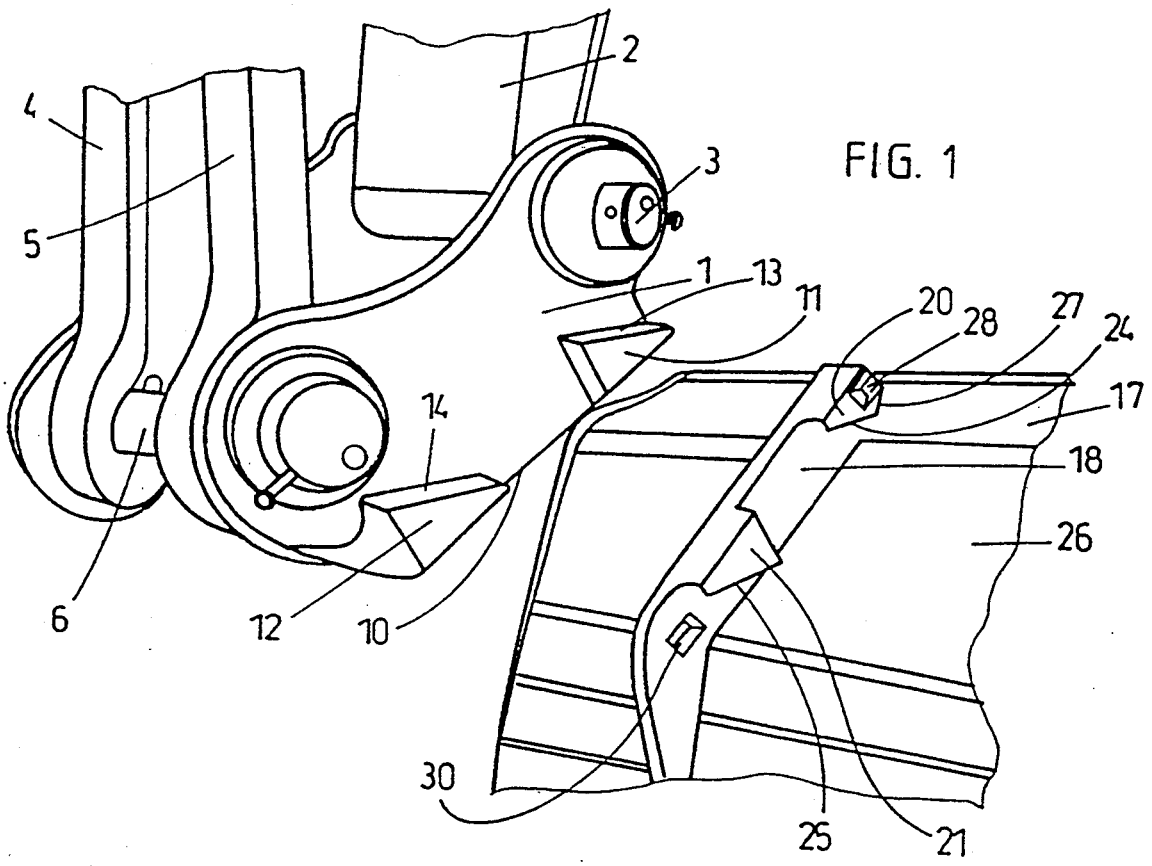
FIG. 1
FIG. 2
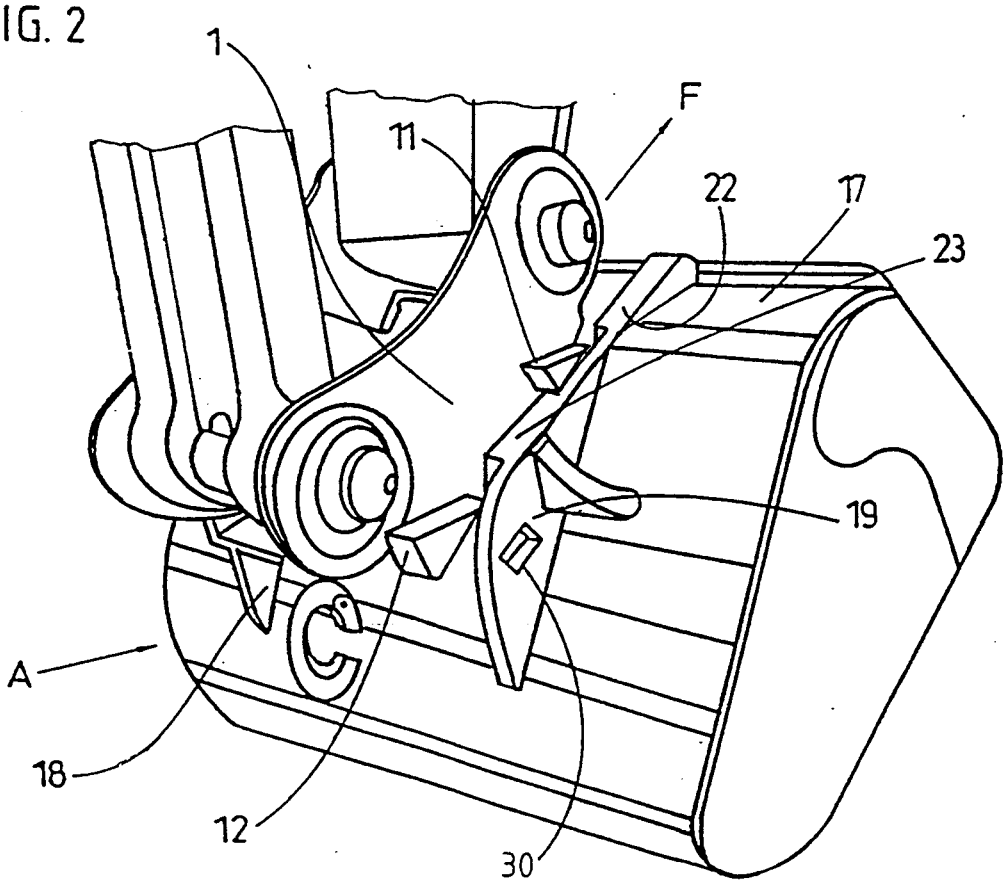

FIG. 3
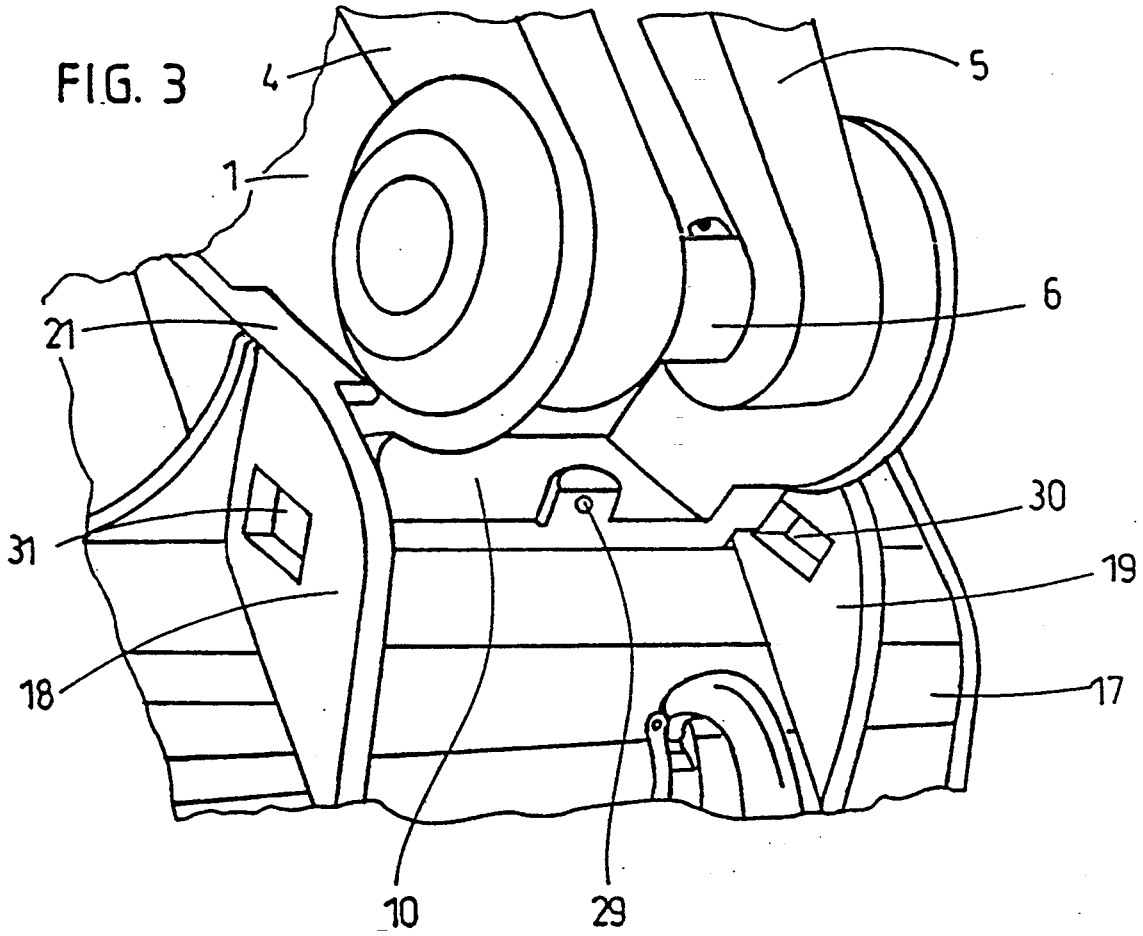
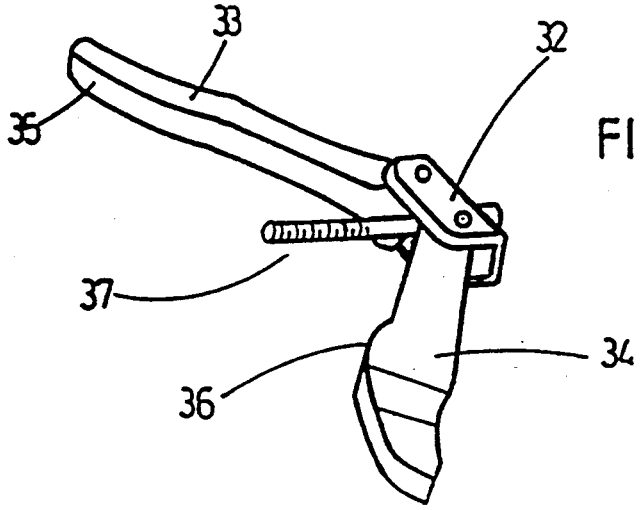
FIG. 4

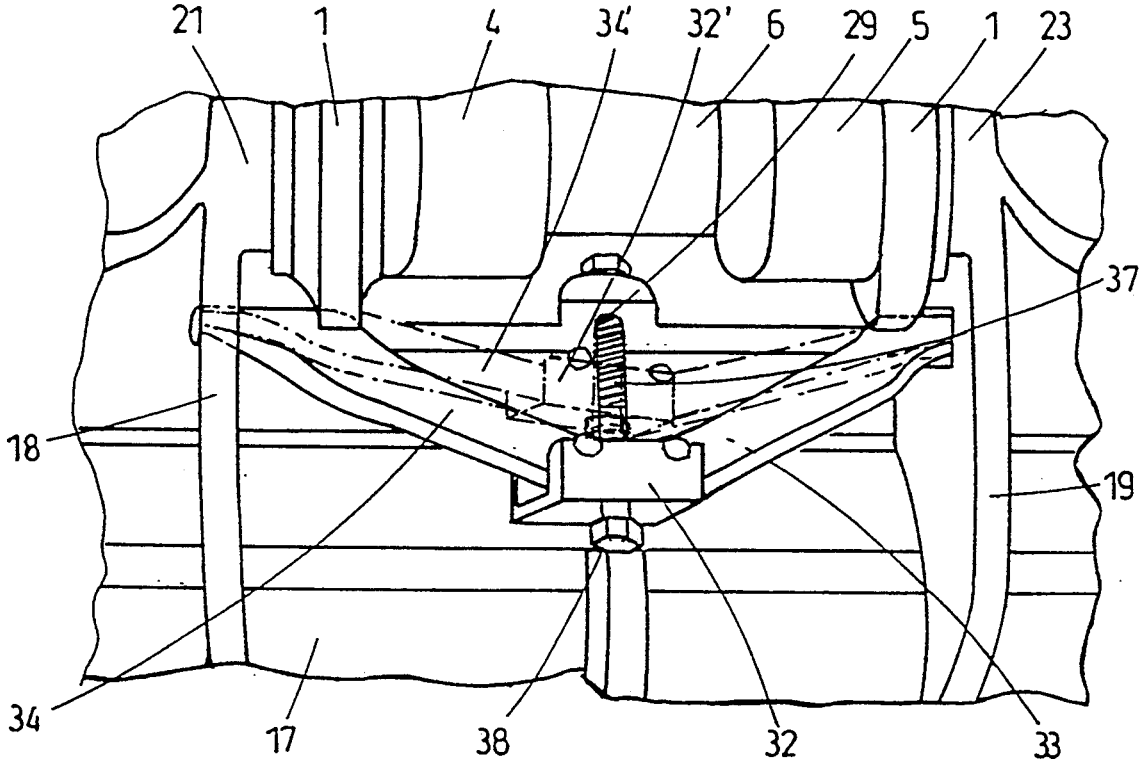
FIG. 5
FIG. 6
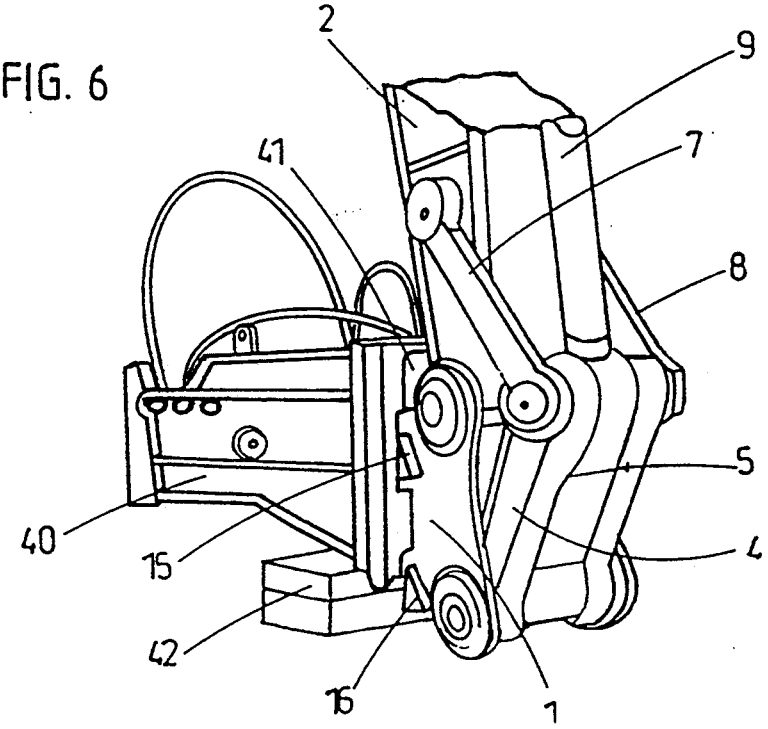

DEVICE FOR MOUNTING A TOOL AT THE END OF A CONSTRUCTION-MACHINE JIB

The present patent application in a continuation-in-part application of the patent application Ser. Nos. 700,490, filed on May 15, 1991, now abandoned, and 906,831, filed on Jun. 30, 1992, now abandoned.

FIELD OF THE INVENTION

The subject of the present invention is a device for mounting a tool at the end of a construction-machine jib equipped with an articulated end piece intended to receive the tool.

PRIOR ART

Construction machines, of the excavator type, currently employ various tools such as buckets of different sizes, hydraulic hammers, concrete grapplers and grabs. These tools are therefore mounted removably on the end piece of the jib of the machine, generally by means of two cylindrical pins, and these two pins must be removed and replaced when the tool is changed. Since these pins are lubricated by means of grease, they are inconvenient to handle and the grease often retains sand and earth.

A mounting without a removable pin is already known. This mounting takes the form, on the one hand, of two cylindrical tenons which engage in two hooks, in the shape of an arc of a circle, of the other piece and, on the other hand, of a wedge-effect fastening ensured by shims. Play exists at the level of the tenons. This play can increase with time under the effect of wear.

SUMMARY OF THE INVENTION

The main object of the present invention is to provide a mounting without a pin and without play.

The mounting according to the invention consists of first profiled parts integral with said end piece, of second profiled parts integral with the tool, these first and/or second profiled parts having ramps behind and on which engage the other profiled parts so as to apply the end piece against the tool, and of a locking means exerting and maintaining a transverse pressure on said engaged profiled parts, this transverse pressure being transformed into axial pressure by said ramps.

The profiled parts preferably consist of two pairs of projections of similar shapes which are fastened together and bear on one another, ramp against ramp, but it would be possible to provide a single pair of projections per piece and/or ramps on only one of the pieces to be assembled, the other piece being equipped with one or two pairs of projections of any shape, for example a cylindrical shape.

In order to change a tool, it is not necessary to disassemble the lubricated pieces and the play is automatically taken up by a slight displacement of the ramps on one another under the effect of the locking means exerting a permanent pressure in the direction of the engagement of the projections with one another.

The profiled parts, in particular the projections, can be formed very close to the articulation points of the end piece, on the one hand, and of the tool, on the other hand, which not only makes it possible to reduce the overall size of the mounting but, furthermore, makes it possible to reduce the distances between the axes of articulation of the end piece and the tool, the consequence of which is a better utilization of the forces. The dead weight of the mounting means is furthermore reduced to a minimum.

BRIEF DESCRIPTION OF THE DRAWINGS

The attached drawing shows, by way of example, an embodiment of the invention.

FIG. 1 is a partial view, in a photographic perspective, of the end of a construction-machine jib and of a bucket intended to be mounted at this end.

FIG. 2 shows the same elements in the course of mounting.

FIG. 3 is a detailed view showing the elements in FIG. 2 in the direction of the arrow A, after complete engagement of the profiled parts.

FIG. 4 is a perspective view of the locking and pressure means.

FIG. 5 is a detailed view of FIG. 3, from a slightly different angle, after the installation of the locking means.

FIG. 6 shows, by way of example, the mounting of another tool, in this case a hydraulic hammer.

DESCRIPTION OF THE PREFERRED EMBODIMENT

Figure 7:
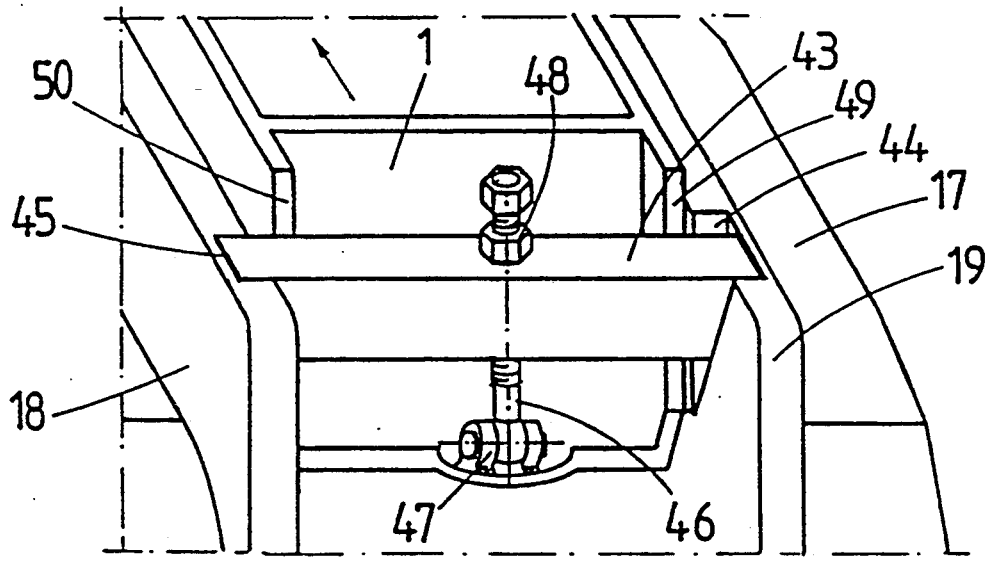
FIG. 7 shows a second embodiment of the locking means.

FIGS. 1 and 2 show the end piece 1 articulated with the end of a jib of a conventional construction machine. This end piece 1 is articulated, in a known manner, on the one hand with the end of a jib 2 by means of a bolt 3 and, on the other hand, with two connecting rods 4 and 5 by means of a bolt 6, the connecting rods 4 and 5 being themselves articulated with the jib 2 by two connecting rods 7 and 8 (FIG. 6) and with the end of a hydraulic jack 9 in a conventional manner.

The end piece 1 has a rectangular, front plane face 10 parallel to the bolts 3 and 6. This face can be cut away in order to reduce the weight of the end piece 1. Each of the side faces of the end piece 1 is equipped with two lateral projections 11 and 12 in the shape of a right-angled triangle, the long side of the right angle being in the plane of the front face 10. Each projection therefore defines a ramp, such as the ramps 13 and 14 which can be seen in FIGS. 1 and 2 and the ramps 15 and 16 of the two opposite projections which can be seen in FIG. 6.

The tool, in this case a bucket 17, has two parallel ribs 18 and 19 which are spaced apart by a distance corresponding to the width of the end piece 1. These ribs are each equipped with two projections 20, 21 and 22, 23 pointing inwards and likewise having ramps such as 24 and 25, the inclination of which, relative to the plane face 26 of the tool, is identical to the inclination of the ramps 13 and 16 relative to the front face 10 of the end piece 1. The distance between the ramps of a same pair is greater than the length of the projections 11 and 12 so as to permit the passage of these projections 11 and 12 between the projections 20 and 21. It should furthermore be pointed out that the ramps 24 of the front projections 20 of the tool 17 are cut with a chamfer 27, and that the lateral faces of the corresponding projections 20 have a boss 28.

The end piece 1 furthermore has, near its front face 10, a hole 29 parallel to the front face. For their part, the ribs 18 and 19 of the tool 17 have two opposite rectangular holes 30 and 31 which are used, with the threaded hole 29, for the locking of the mounting, as will be described below.

The mounting device shown in FIG. 4 comprises a central piece 32 in the form of a fork-joint, on which are articulated two arms 33 and 34 which are slightly bent back at their end and have a boss 35, 36 respectively, the role of which, as a cam, will be described later. The central piece 32 carries a bolt 37.

The mounting operates in the following manner: with the bucket 17 placed on the ground, the end piece 1 is engaged between the ribs 18 and 19 of the bucket 17, initially perpendicularly to the face 26 of the bucket, the projections 11 and 12 engaging between the projections 20 and 21, and 22 and 23, respectively, and then substantially parallel to the plane 26, in the direction of the arrow F, as shown in FIG. 2. The projections 11 and 12, on both side faces of the end piece 1, engage beneath the corresponding projections of the bucket 17. Under the action of the ramps 13 to 16 and the corresponding ramps of the projections of the bucket 17, the latter is applied against the front face 10 of the end piece 1. The bosses 28 (FIG. 1) cause the lateral play of the end piece 1 in the tool to be eliminated.

The locking and pressure device is then installed by introducing the end of the arms 33 and 34 into the holes 30 and 31 of the bucket 17 and by engaging the screw bolt or tie rod 37 through the hole 29 of the end piece, and a nut is screwed onto the protruding end 1, as shown in FIG. 5. Using a first wrench on the head 38, the screw bolt 37 is then rotated while, holding the nut in place by means of a second wrench, which causes the locking and pressure device to be tensioned in order to bring it into a position as shown in dot-dash lines in FIG. 5. During this tensioning, the arms 33 and 34 are braced in the holes 30 and 31, exerting by way of their bosses 35 and 36 a pressure on the end piece 1, in the direction of the arrow F in FIG. 2. The locking device not only causes the end piece 1 and the bucket 17 to be held fastened together, but also causes a permanent tension a continuous compressive force, to be maintained which tends to apply the bucket 17 against the end piece 1. Because of this tension and the ramps of the fastening projections, which are held together with a wedging effect by the tension, any play due to wear is automatically taken up, with the result that the attachment remains absolutely rigid. It will be noted, in particular in FIG. 3, that the mounting takes place very close to the bolts 3 and 6, with the result that the torques exerted on the bolts 3 and 6 are reduced to a minimum. The mounting is particularly compact.

This mounting method can, of course, be applied to any type of tool. FIG. 6 shows, by way of example, the mounting of a hydraulic hammer 40. This hammer is equipped with a female part 41 identical to the female part of the bucket 17. For its mounting on the construction machine, the hammer 40 is placed on a plank 42 so as to be able to engage from below the end part 1 with its male profiles. Once completely engaged, the end part 1 raises the hammer and it is then possible to install the locking device.

It should be pointed out that the locking device is subjected to only relatively small forces. These forces are especially small since the slope of the fastening ramps is small. The wedge effect of the projections can be such that the mounting is virtually ensured by these projections alone. In this case, in order to remove the tool, it is necessary to strike the end piece 1 using the undercut portion 27.

The locking of the tool on the end piece can be ensured by means other than those shown in FIGS. 4 and 5. Another embodiment of the locking means is shown on FIG. 7.

For reasons of simplification, the end piece and the tool have been designated by the same reference numerals 1 and 17 as in the previous figures, even though these elements have a different form and dimension.

The locking means shown in FIG. 7 consist of a transverse bar 43, at least the ends of which have a wedge-shaped profile and are engaged in two V-shaped notches 44 and 45 formed in the parallel ribs 18 and 19 of the tool 17, in this case a bucket. At its center, the bar 43 has a hole for the passage of a tie rod 46 pivotably connected at a point 47 on the end piece 1 and onto which is screwed a nut 48 intended to maintain a certain pressure on the bar 43. This bar bears against the two inclined ends 49 and 50 on either side of the end piece 1. The wedge effect maintains a pressure in the direction of the arrow. This embodiment is particularly simple and robust. The bar 43 could bear against the lateral projections 11 and 12 of the end piece.

According to an embodiment which is not shown, the locking means consists of a pair of catches mounted so as to slide in a transverse groove of the end piece 1 and engaging with an oblique flank in two housings provided in the parallel ribs 18 and 19 of the tool, a spring and/or a jack being provided between the catches, on the one hand in order to exert a permanent axial pressure on the catches and, on the other hand, to free the catches from their housings in order to separate the tool from the end piece. The jack can be single-acting or double-acting.

The invention is, of course, not limited to the embodiments shown. In particular, the number and shape of the projections could be different. The projections of one of the pieces to be assembled could have no ramps and have, for example, a circular or semi-circular or reasonably rounded profile.

The end piece and the tool could each be equipped with a single pair of projections, for example triangular projections as shown in the drawing, but placed approximately half-way between the ends of the ribs, and from the sides of the front face 10 of the end piece, respectively. Indeed, only one pair of projections is sufficient to press the front face 10 of the end piece against the plane face 26 of the tool.

Figure 8:
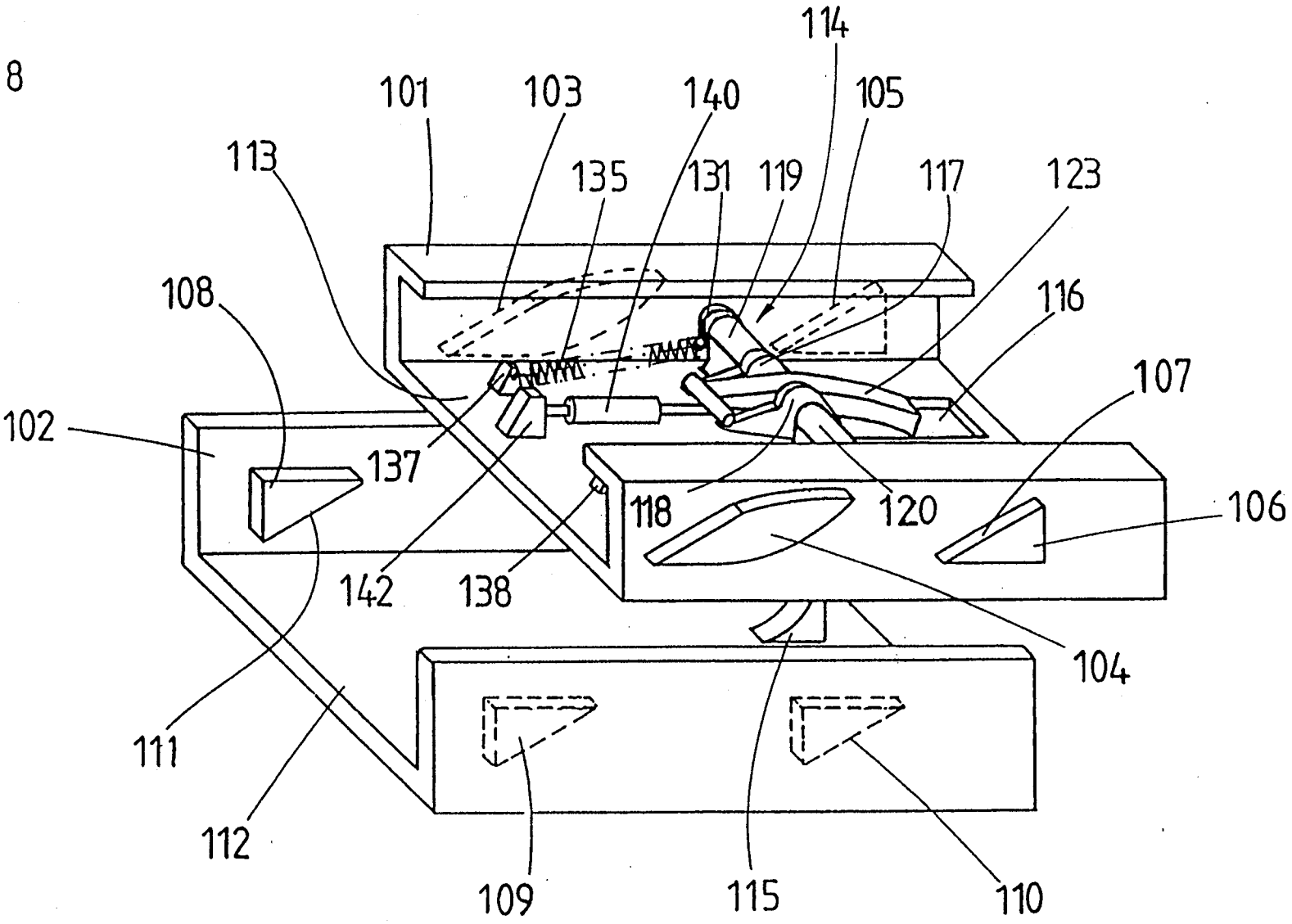
FIG. 8 is a diagrammatic view, in perspective, of the essential means of the mounting device according to a third embodiment.

In FIG. 8, an end piece 101 has been shown diagrammatically which is intended to be mounted on the end of a construction-vehicle jib in the conventional manner, and a piece 102 forming part of a tool, for example a bucket. In reality, the piece 101 must also have lugs supporting bearings for mounting the end piece on the jibs of the vehicle by means of pins as described previously.

The end piece 101 is laterally equipped with two pairs of projections 103, 104 and 105, 106 having an oblique ramp such as the ramp 107.

The piece 102 of the tool also has four projections, three of which 108, 109, 110 can be seen in the drawing. These projections have an oblique ramp such as the ramp 111. The engagement of the piece 101 in the piece 102 takes place as described previously. The ramps of the corresponding projections engage on each other, applying the plane face 112 of the piece 102 against the plane face 113 of the piece 101.

The locking in the fastened position, and the taking up of the play owing to wear are effected by a mechanism 114 housed in the piece 101 and interacting with a projection 115 of the piece 102. The mechanism 114 has been designed in such a way as to be able to be housed in a space of small height, corresponding in practice to the height of the fastening projections. In reality, this space is closed on all sides, with the exception of a rectangular cut-out 116 in the face 113, with the result that the locking mechanism 114 is protected from sand and earth when the pieces 101 and 102 are assembled.

Figure 12:
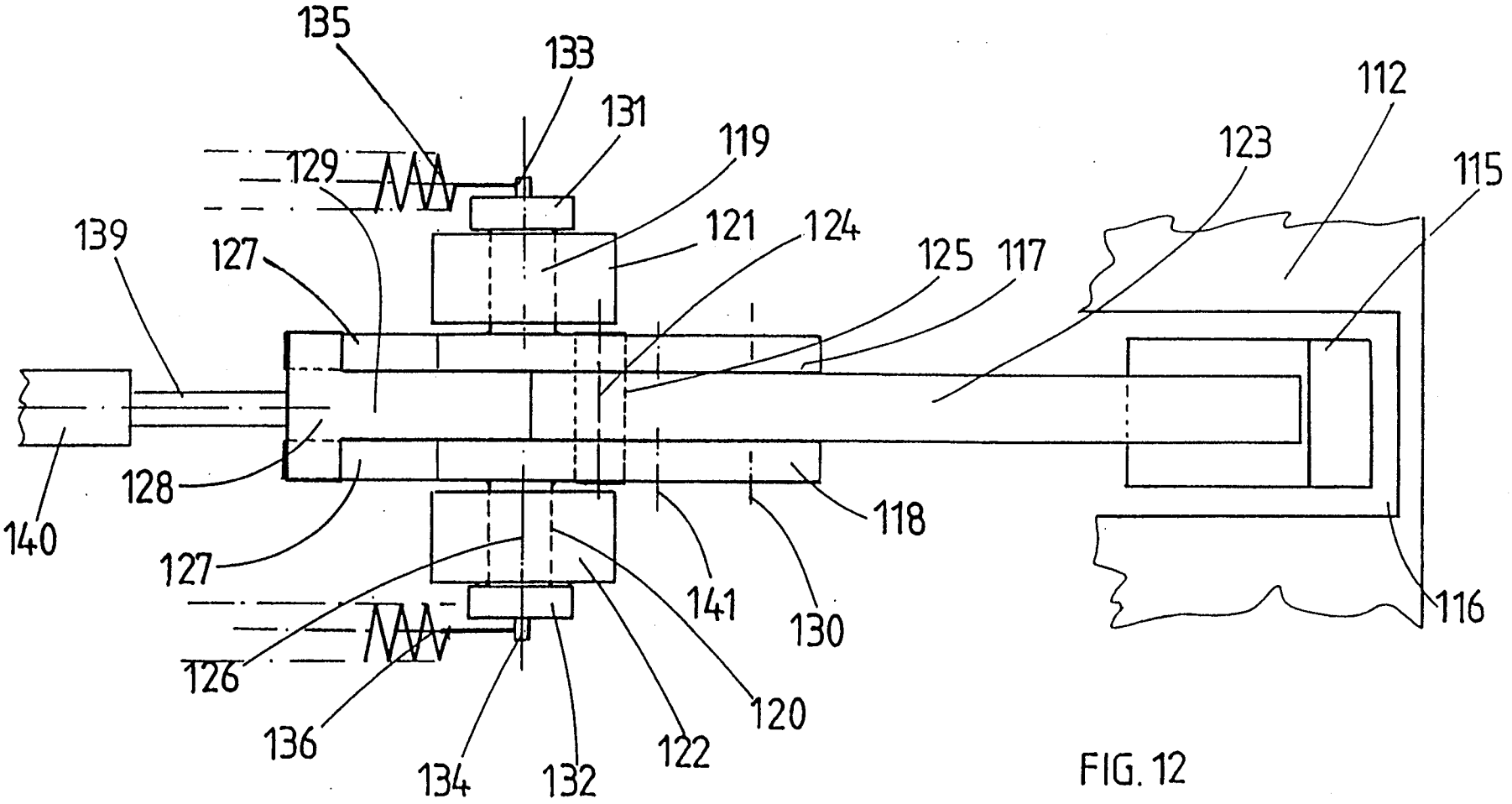
FIG. 12 is a top view of the mechanism for locking in the position shown in FIG. 11.
Figure 13:
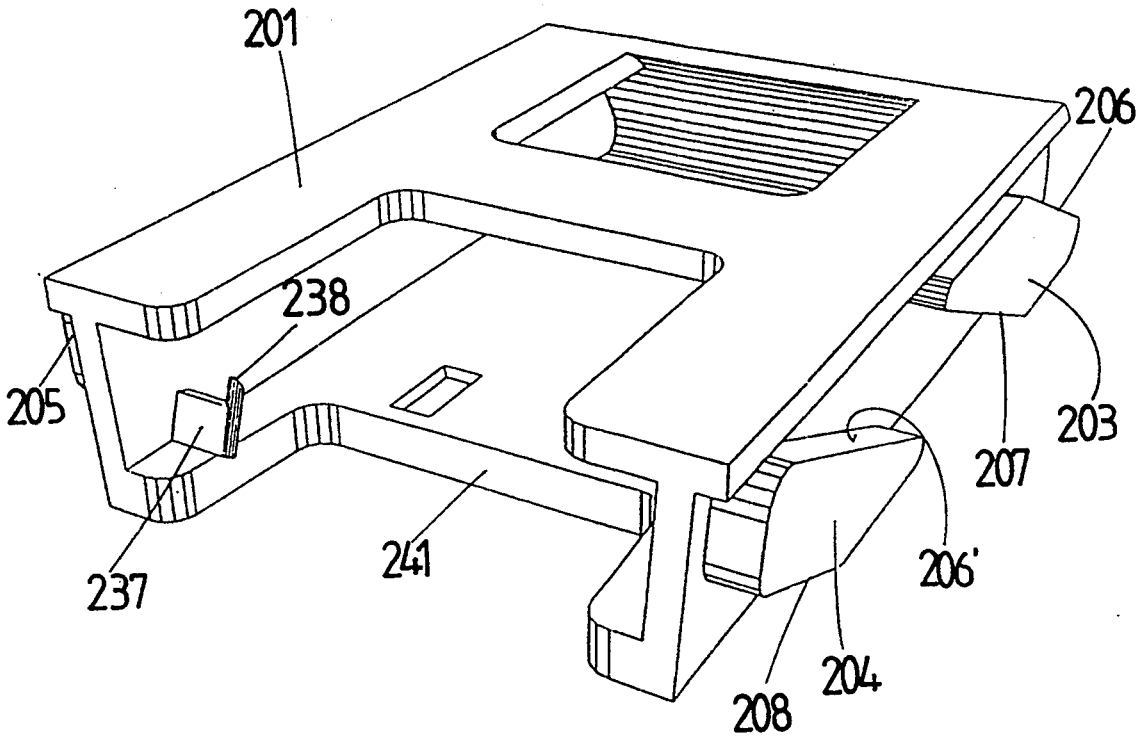
FIG. 13 is a perspective view of the end piece integral with the machine of another embodiment, without the locking means.
Figure 14:
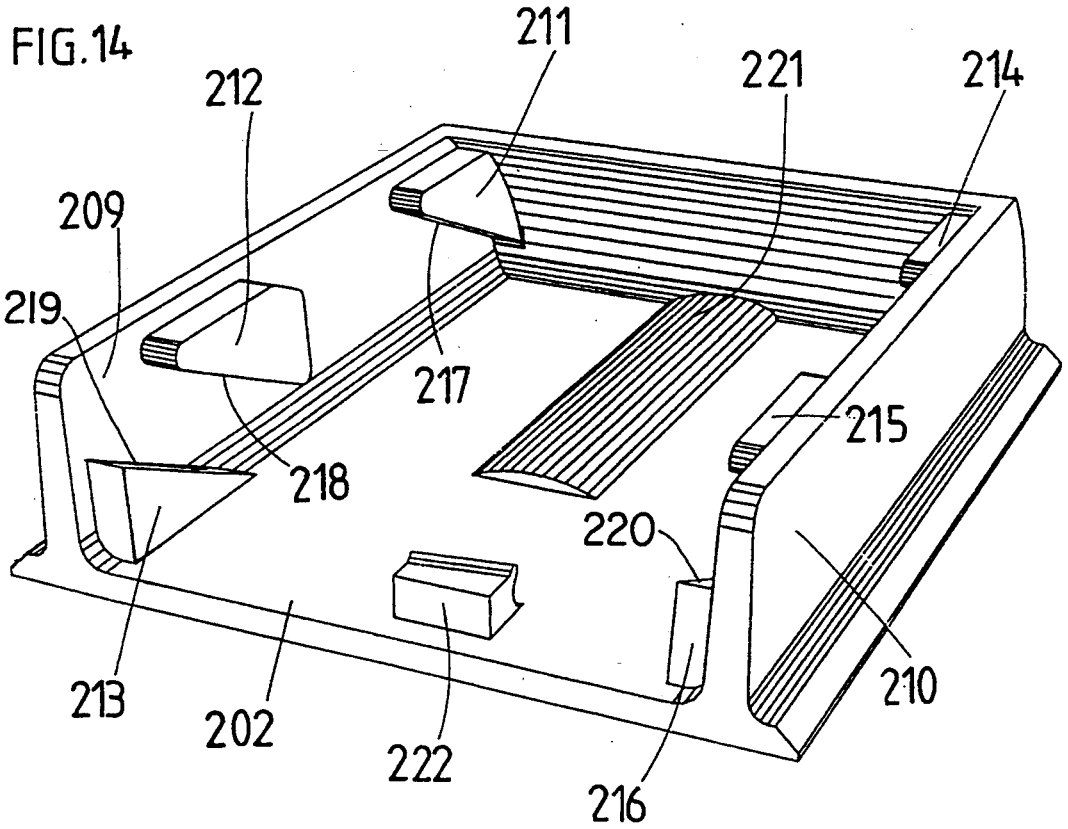
FIG. 14 is a perspective view of the female piece integral-with the tool of this embodiment.

The mechanism 114 for locking and taking up the play will be described by means of FIGS. 8, 9 and 12.

The mechanism comprises a lever consisting of two parallel profiled plates 117 and 118 integral with a shaft, consisting of two pieces 119 and 120, by means of which the lever is mounted pivotably in two bearings 121 and 122 welded to the face 113 and to the opposite wall, not shown. A locking finger 123 is pivotably mounted on the lever, between the plates 117 and 118, about an axis 124. A spacer 125 is positioned between the plates 117/118 at the axis 124. The axis 124 is off-centered relative to the axis of pivoting 126 of the lever, and it is situated in front of this pivot axis, towards the end of the finger 123, slightly below the straight line d connecting the axis 126 to the center of the end of the finger 123, in other words slightly below the point A.

An extension of the plates 117/118 consists of a nose 127 interacting with a transverse bar 128 mounted at the end of an extension piece 129 of the finger 123, behind its pivot axis on the lever.

An active part of each plate 117/118 consists of a spacer 130 intended to raise the finger 123 during the unlocking operation, as will be described below.

At the ends of the shaft 119/120 of the lever there are mounted cover plates 131 and 132 which are respectively equipped with a crank pin 133, 134 to which are respectively attached two traction springs 135 and 136, the other ends of which are fastened at points 137 and 138 respectively of the piece 101. These springs bias the lever in the direction of the arrow F1 in FIG. 9, in such a way that the locking finger 123 is held in a lowered position by the noses 127 of the lever.

The rod 139 of a jack 140 pivotably mounted between the plates 117 and 118 via a shaft 141 is also connected to the plates 117/118. The jack 140 is a single-acting pneumatic or hydraulic jack exerting a thrust. The other end of the jack is pivotably connected at a point 142 of the piece 101. The device functions as follows:

The description starts from the disassembled position shown in FIG. 8. In this position, the locking mechanism of the end piece 101 occupies the position shown in FIG. 9. When the piece 101 is engaged into the piece 102, the projection 115 of the piece 102 penetrates into the piece 101 via the cut-out 116 and abuts the locking finger 123.

Figure 10:
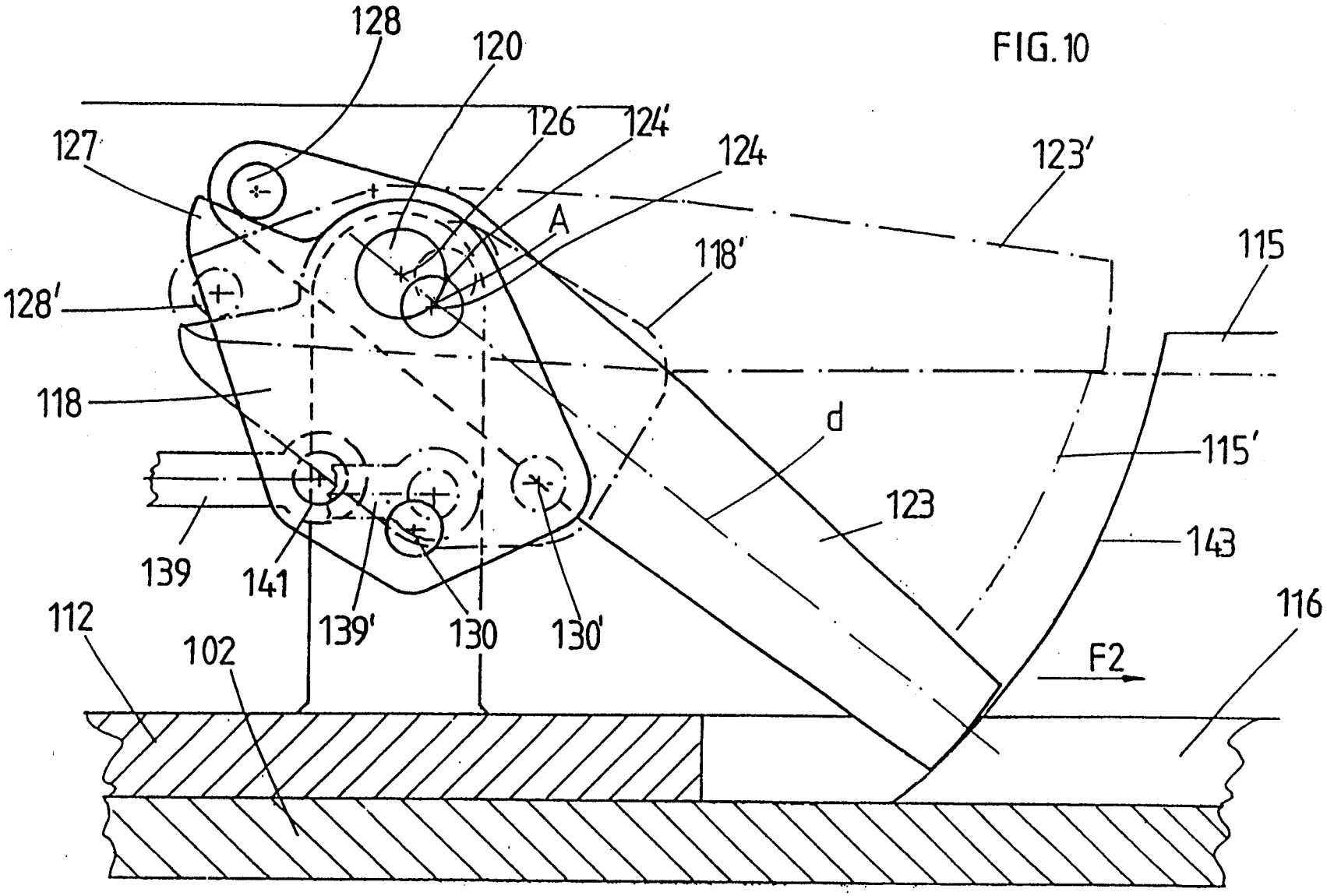
FIG. 10 is a view similar to that in FIG. 9, showing the locking device in the locking position and, in dot-dash lines, in the course of fastening the tool.

The projection 115 then raises the finger 123 under the effect of the ramps of the fastening projections 103 to 110, counter to the action of the springs 135 and 136. Shortly after the projection 115 and the locking finger 123 have reached the position 115' and 123' shown in dot-dash lines in FIG. 10, the projection 115, which is displaced obliquely, separates from the locking finger 123 which is pushed down under the effect of the springs 135 and 136. The projection 115 has a ramp 143 consisting of a curved surface, the radial center of which is situated above and in front of the axis 126, in the completely engaged position of the pieces 101 and 102. The finger 123 thus at a given moment encounters the concave ramp 143, as shown in FIG. 10, exerting a thrust on the projection 115 in the direction of the arrow F2, through a component of the pressure of the locking finger 123 on the ramp 143. The piece 102 is thus locked in the piece 101 and, on the other hand, by virtue of the ramp 143, all play owing to the wear of the means of fastening, in particular of the ramps of the fastening projections, is automatically taken up by the finger 123, still under the effect of the springs 135 and 136. The stability of this locked position is ensured by the position of the pivoting axis 124 very slightly below the axis or center line d of the finger 123 passing through the pivot axis 126, in such a way that vibrations and stresses other than those from the jack 140 are insufficient to cause the axis 124 to pass beyond the point A.

Figure 11:
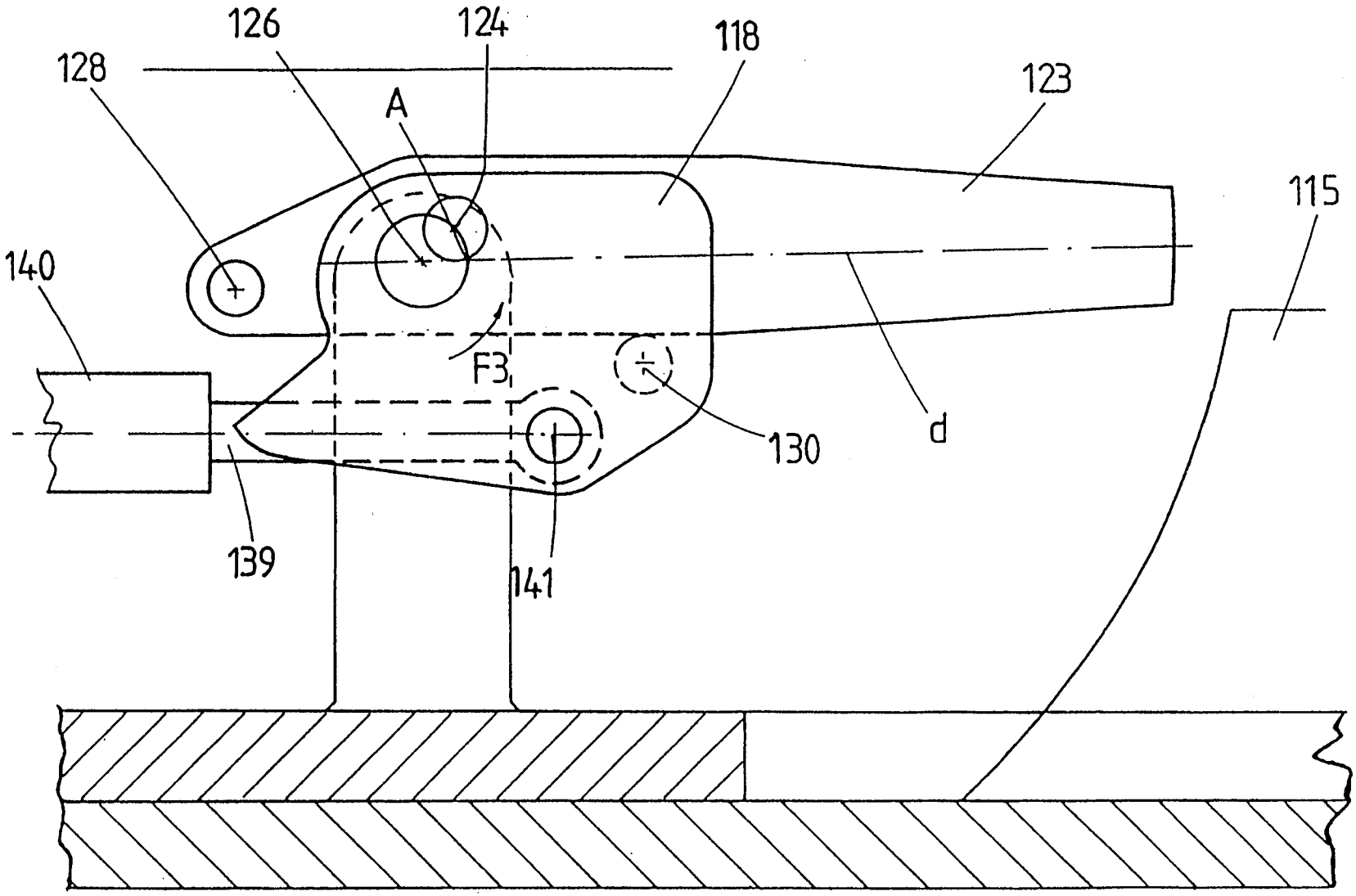
FIG. 11 is a view similar to the previous figures, showing the locking device in the unlocked position.

To unlock, the jack 140 is operated and makes the lever 117/118 pivot in the direction of the arrow F3, as shown in FIG. 11. By reason of the off-centered articulation 124 of the finger 123 on the plates 117/118 and of its position relative to the end of the finger 123, the axis 124 firstly approaches, by a few hundredths of mm, the ramp 143 of the projection 115, and then, after passing through the hard point A, moves away from the ramp 143 so that the finger 123 has a withdrawal movement before the spacer 130 reaches the finger 123 in order to raise it and disengage the finger from the projection 115, thus permitting separation of the pieces 101 and 102 from the coupling. This preliminary withdrawal movement enables the finger to be unfastened from the ramp 143 without having to overcome very large friction forces. The only exertion having to be supplied by the jack is the exertion required to effect the passage of the axis 124 beyond the point A and to overcome the force of the springs 135 and 136.

Figure 9:
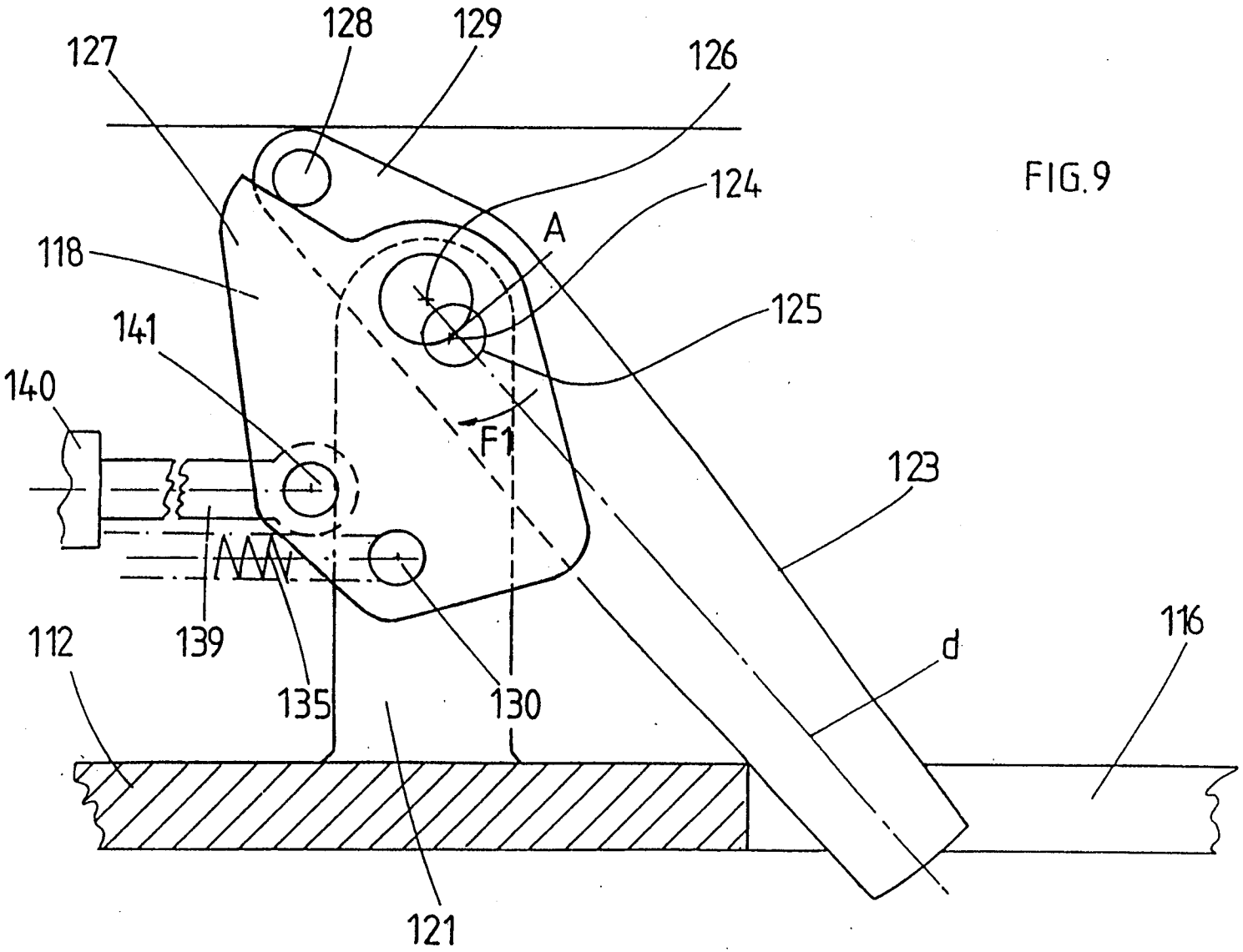
FIG. 9 is a profile view of the mechanism for locking the end piece in FIG. 8 in the rest position and in the absence of a tool.

As soon as the piece 101 has disengaged from the piece 102 of the tool, the jack 140 can be deactivated and the springs 135 and 136 return the locking mechanism to the position shown in FIG. 9.

In practice, two 200 kg springs are sufficient to effect the locking and the taking up of the play. The withdrawal of the finger 123, before rotation, is of the order of 3 mm during the unlocking operation.

The lever and its elastic return could, of course, be produced in a different manner.

Another embodiment of the mounting and of its locking means will now be described with reference to FIGS. 13 to 16.

As in the first embodiment, the mounting comprises, on the one hand, a male end piece 201 intended to be mounted at the end of the jib of a construction machine. The means for mounting onto this jib have not been shown. They are of the same type as in the first embodiment. The mounting is composed, on the other hand, of a female piece 202, represented in FIG. 14, integral with the tool, for example a bucket of a mechanical digger.

The end piece 201 is in the form of a perforated box structure the side walls of which are externally equipped with two pairs of projections, the projections 203, 204 and 205 of which can be seen in the drawing. These projections have oblique ramps 206 and 206' serving in the mounting and the locking. The projections 203 and 204 moreover have ramps 207 and 208 which are opposite the ramps 206 and 206' and which serve to guide the end piece 201 in the course of its engagement in the female piece 202. The floor of the end piece has a cutback limited by a side 241 on which the locking thrust is exerted.

The female piece 202, in the form of an open box structure, has two parallel side walls 209 and 210. The wall 209 internally has three projections 211, 212, 213. The wall 210 internally has three projections 214, 215, 216 which are located respectively facing the projections 211, 212, 213. The projections 211 and 212 have ramps 217 and 218, as do the projections 214 and 215. These ramps are intended to interact with the ramps 206 and 206' of the end piece 201 so as to apply the piece 201 against the bottom of the piece 202. The piece 213 has a ramp 219 parallel to the ramp 218. The piece 216 has a similar ramp 220. The spaces between, on the one hand, the projections 212 and 213 and, on the other hand, the projections 215 and 216 serve to guide the projections 204 and 205 in the course of the engagement of the end piece 201 in the female piece 202. In the course of this engagement, the ramps 208 slide over the ramps 219 and 220. When it is engaged in the piece 202, the piece 201 comes to bear on the bottom of the piece 202. It is held laterally by a boss 221 engaging in a corresponding indentation formed in the piece 201.

Figure 15:
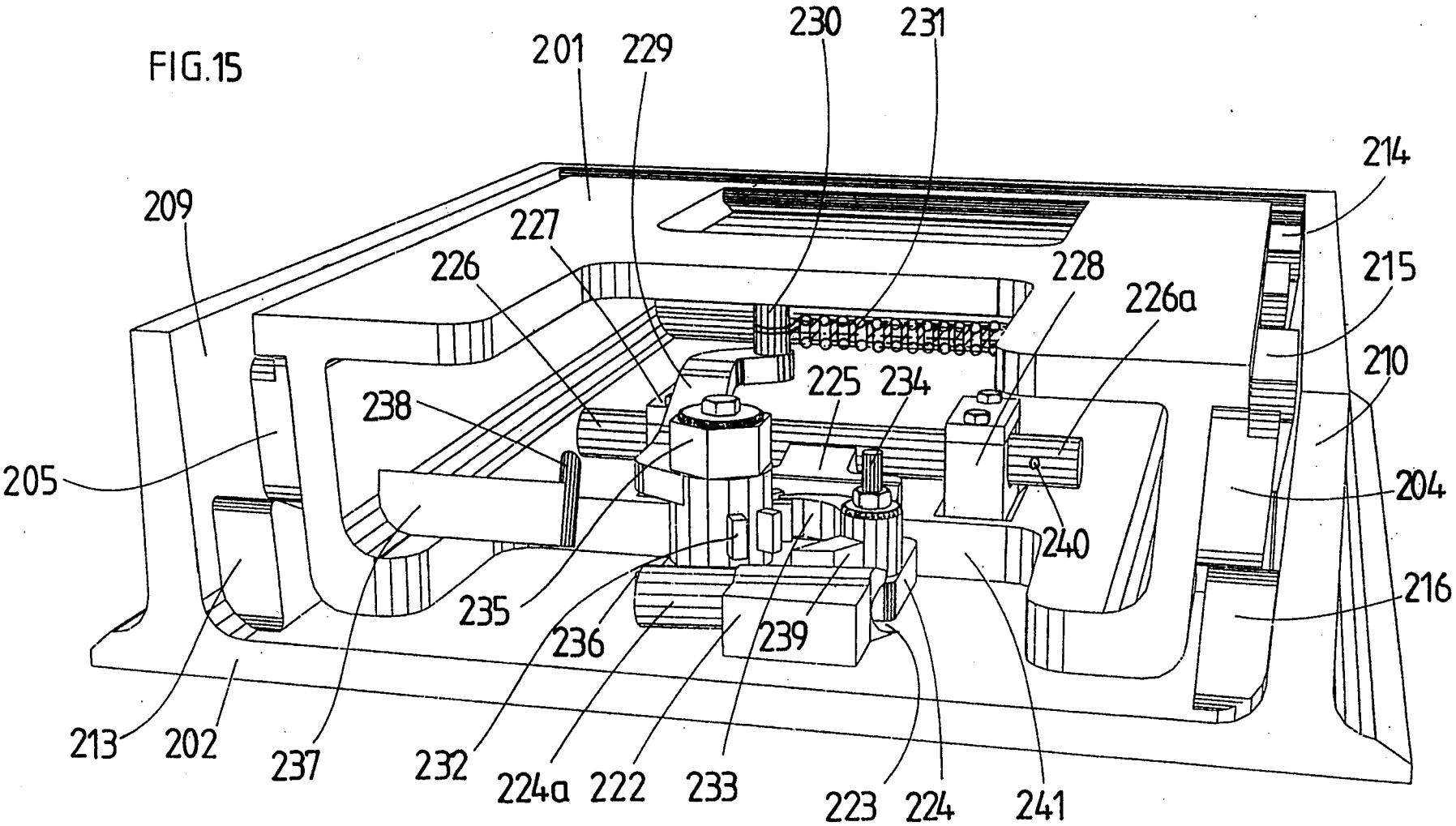
FIG. 15 is a perspective view of the assembled pieces of the mounting showing the locking means in the locking position, of this same embodiment.

There will now be described, by means of FIGS. 15 and 16, the means for locking the pieces 201 and 202. On the bottom of the piece 202, at the entry to the latter, is formed a stop 222. This stop 222 has a profile with a cylindrical surface 223, whose axis is oblique relative to the walls 209 and 210.

On the end piece 201 is mounted a lock 224 which has, in plan view, a wedge shape and an oblique side **224*a* of cylindrical profile similar to the profile 223 of the stop and whose axis is parallel to that of the stop. This lock 224 is fixed, by a bent radial arm 225, to a shaft 226 mounted so that it can rotate in two bearings 227 and 228 fixed into the floor of the end piece 201. The shaft 226 can furthermore move translationally in the bearings 227 and 228. A crank 229 swivels on the lock 224 about an axis perpendicular to the arm 225. The end of the arm of the crank 229 is equipped with a crank pin 230 to which is fastened one of the ends of a spring 231 extending parallel to the shaft 226 and the other end of which is fastened to the piece 201. The spring 231 works in tension. The hub of the crank 229 is equipped with radial teeth 232 interacting with a ratchet 233 swivelling on the lock 224 about a pin 234 and kept bearing against the toothing of the crank by a light spring. The end of the hub of the crank 229 is formed of a standardized hexagon head 235. The lock 224 is moreover laterally equipped with a ring 236. The side wall of the end piece 201 facing this ring 236 is equipped with a perpendicular arm 237 at the end of which is formed a cylindrical finger 238 the diameter of which is less than the internal diameter of the ring 236. The lock 224 is moreover equipped with a protuberance 239 having a flat extending above the stop 222 in the locking position. The role of this protuberance will emerge in the course of the description of the unlocking. The end 226*a* of the shaft 226 extending beyond the bearing 228 in the locking position may be pierced with a diametral hole 240** intended to receive a locking pin.

Having described the device in the locking position, its use will be described starting from the locking position represented in FIG. 15.

In this locking position, the end piece 201 is fully engaged in the female piece 202 and the lock 224 is fully engaged, like a wedge, between the front face 241 of the end piece and the stop 222 with its rounded part **224*a* engaged in the groove 223 of the stop 222. By means of a wrench, the user has turned the shaft of the crank 229 via its hexagon head 235 in the counterclockwise direction, which has the effect of giving the spring 231 a certain tension. The spring thus pulls on the crank 229, that is to say on the lock 224 in the direction of the bearing 228. The hub of the crank is retained by the ratchet 233. The reaction of the stop 222 on the face 241 maintains a permanent thrust in the direction of engagement of the pieces 201 and 202. It will be shown that the loads to which the shaft 226 and its bearings 227 and 228** are subjected, are very low.

To remove the tool, the pieces 201 and 202 are unlocked. By means of the wrench the hub of the crank 229 is turned slightly via its hexagon head 235 in the counterclockwise direction so as to allow the ratchet 233 to disengage from the teeth 232. This disengagement takes place easily with the finger, the ratchet spring offering only a small amount of resistance. The spring 231 can thus relax, which makes it possible to move the lock 224 easily toward the left so as to disengage it from the groove 223 of the stop. If necessary, the protuberance 239 is struck once or twice with a hammer to detach the lock 224 from the stop 222. As soon as this disengagement is sufficient, the lock 224 is raised by the rotation of the shaft 226 and fastened by its ring 236 onto the finger 238, as shown in FIG. 16. In this position, a slight tension on the spring 231 keeps it in the fastened position. It is then possible to withdraw the piece 201 from the female piece 202, the lock 224 passing above the stop 222.

Figure 16:
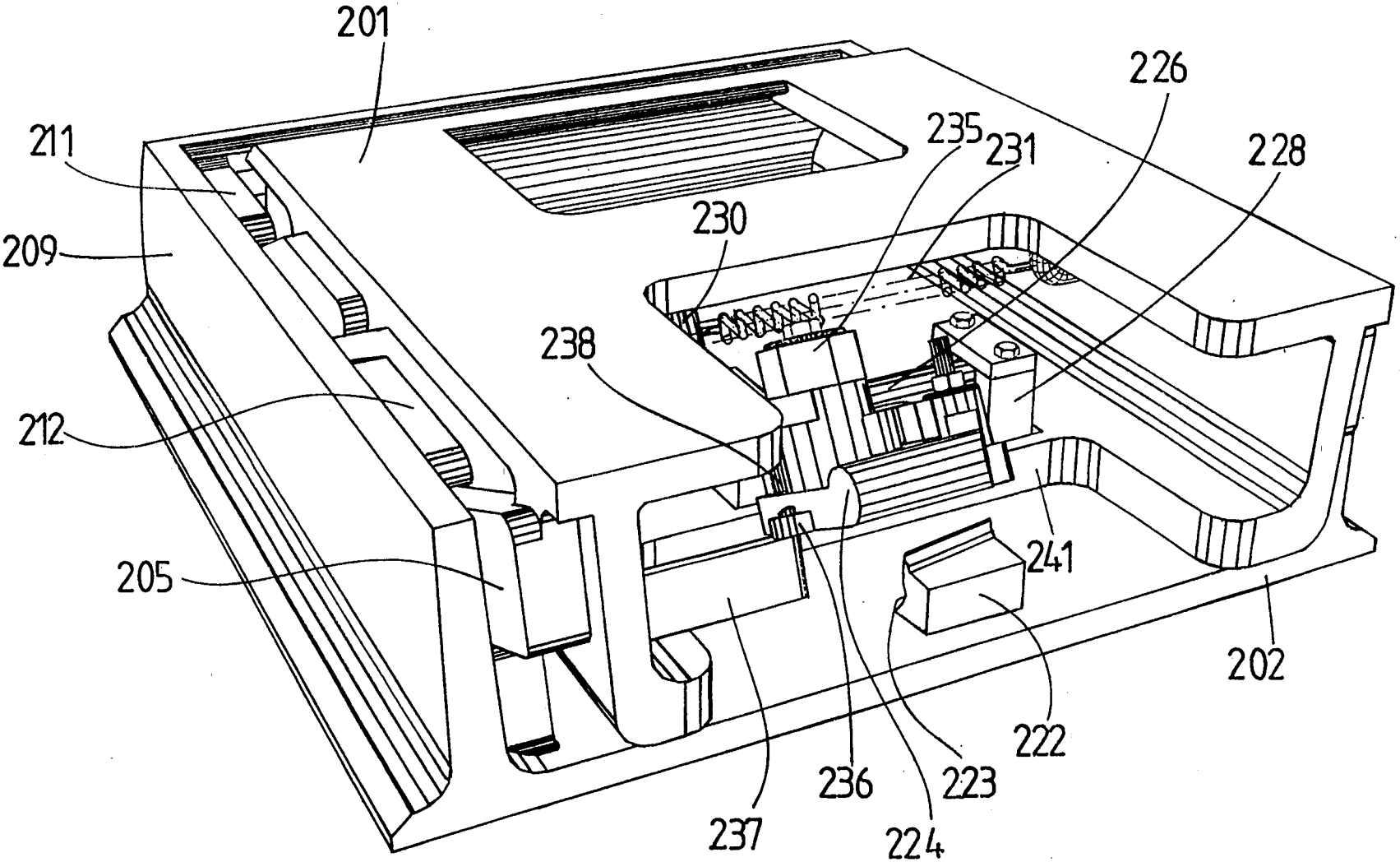
FIG. 16 is a perspective view, with a different perspective from that of FIG. 15, showing the locking means in the unlocking position.

Conversely, with the lock 224 in the fastened position shown in FIG. 16, it is possible to engage the end piece 201 in the female piece 202 of a tool. Once in the position shown in FIG. 16, the lock 224 is detached from the finger 238 and pushed back or pulled by the spring 231 into the groove 223 of the stop 222. By means of the wrench the spring 231 is given the desired tension. We are now back in the position shown in FIG. 15.

The profile of the stop and of the lock could of course be different from the profile shown. The lock and the stop could for example bear via faces which are perpendicular to the bottom of the piece 202, or slightly oblique relative to this bottom. The lock could be kept in the raised position and separated from the stop by any other means.

The design of the locking means makes best use of the space available between the end piece of the arm of the machine and the tool, and these means are relatively well protected against impacts.

I claim:

1. A device for mounting a tool at the end of a construction-machine jib comprising:

an end piece for connection to said machine jib, said end piece having a pair of sides and each said side including a pair of integrally fixed and transversely extended first projections, each said first projection having a first ramp surface, a tool having a pair of mounting surfaces, said mounting surfaces being spaced by a distance sufficient to receive said end piece therebetween, each said mounting surface including a pair of integrally fixed and transversely extended second projections, each said second projection having a second ramp surface, said first projections and said second projections being interengaged when said tool is operatively connected to said jib with each said second ramp surface resting against and beneath a respective one of said first ramp surfaces, locking means connected between said tool and said end piece for exerting a continuing force maintaining said projections in said interengagement, said continuing force inducing a compressive force acting between each said interengaged first and second ramp surfaces, play between said first and second ramp surfaces being eliminated by said compressive force regardless of wear on said first and second ramp surfaces.

2. A mounting device as in claim 1, wherein said first and second ramp surfaces are planar, and said compressive force acts transversely to the direction of said continuing force applied by said locking means, whereby a wedging effect is provided at said engaged projections.

3. A mounting device as in claim 2, wherein said end piece sides are generally parallel and said tool mounting surfaces are generally parallel.

4. A device for mounting a tool at the end of a construction-machine jib comprising:

an end piece for connection to said machine jib, said end piece having a pair of sides and each said side including at least one pair of integral and transversely extended first projections, each of said first projections having a first planar surface, a tool having a pair of mounting surfaces, said mounting surfaces being spaced apart by a distance sufficient to receive said end piece therebetween, each of said mounting surfaces including at least one pair of integral and transversely extended second projections, each of said second projections having a second planar ramp surface, said first projections and said second projections being interengaged when said tool is connected to said jib with each said first planar ramp surface riding under a respective one of said second planar ramp surfaces, said first projections on said end piece being spaced apart and said second projections on said tool being spaced apart, an end piece first projection on each said side being dimensioned to pass through a space between second projections on the associated mounting surface of said tool, said first and second ramp surfaces being brought into said engagement in mounting said tool to said jib by passing first projections through said spaces between second projections and positioning said first ramp surfaces of said end piece beneath second ramp surfaces of said tool, locking means connected between said tool and said end piece for exerting a continuing force maintaining said projections in said interengagement, said continuing force including a compressive force acting between said interengaged first and second ramp surfaces, play between said first and second ramp surfaces being eliminated by said compressive force regardless of wear on said first and second ramp surfaces, said compressive force acting transversely to the direction of said containing force applied by said locking means, whereby a wedging effect is provided at said engaged projections.

5. A device for mounting a tool at the end of a construction-machine jib comprising:

an end piece for connection to said machine jib, said end piece having a pair of sides and each said side including at least one integral and transversely extended first projection, said at least one first projection having a first planar ramp surface, a tool having a pair of mounting surfaces, said mounting surfaces being spaced by a distance sufficient to receive said end piece therebetween, each said mounting surface including at least one integral and transversely extended first projection, said at least one first projection having a second planar ramp surface, said first projections and said second projections being interengaged when said tool is connected to said jib with each said first planar ramp surface riding on a respective one of said second planar ramp surfaces, locking means connected between said tool and said end piece for exerting a continuing force maintaining said projections in said interengagement, said continuing force including a compressive force acting between said interengaged first and second ramp surfaces, said compressive force acting transversely to the direction of said containing force applied by said locking means, whereby a wedging effect is provided at said engaged projections, play between said first and second ramp surfaces being eliminated by said compressive force regardless of wear on said first and second ramp surfaces, said locking means including:

a central piece, a pair of arms connected to and extending in opposite directions from said central piece, said arms having cam surfaces at their free ends, said free ends engaging said tool at said cam surfaces, a threaded tie rod extending through said central piece and engaging said end piece, turning said tie rod in one direction generating said continuing force on said end piece by longitudinally stressing said tie rod.

6. A mounting device as in claim 1, wherein said end piece is articulated to said machine jib.

7. A mounting as in claim 4, wherein said locking means includes a transverse bar having, at least at its ends, a wedge-shaped profile which engages in two notches provided in said mounting surfaces, said bar bearing against the end piece and against the tool respectively, and said bar having a threaded tie rod extended to engage the end piece and when rotated in one direction said tie rod pulling said bar farther into the notches to increase said compressive force.

8. A device for the quick mounting of a tool at the end of a construction-machine jib, comprising:

an end piece for mounting at the end of the jib and provided on opposite sides with two pairs of lateral projections having first ramps which fasten onto second ramps of two pairs of corresponding lateral projections on opposite mounting surfaces of the tool to apply the tool against and in front of the end piece, locking means comprising a lever, which lever is pivotably mounted on the end piece about an axis transverse to the sides and mounting surfaces, and a locking finger pivotably mounted on the lever about an axis parallel to the axis of pivoting of the lever and bearing on a bearing face of the tool under the effect of a spring so as to lock the tool on the end piece and to take up the play due to wear, a jack for effecting unlocking by exerting on the lever an opposite force to that of the spring, said lever being pivoted at an intermediate point so as to have two separate arms, the axis of pivoting of the locking finger being situated between the pivot axis of the lever and the end of the locking finger in the locking position, a plane containing the axes of pivoting of the lever and of the locking finger being always at least slightly below a center line of the locking finger, driving of the locking finger by the lever causes a slight forward movement, followed by a withdrawal of the locking finger before said locking finger is driven in rotation about its axis by the lever in the unlocking direction, the locking finger having an extension beyond the pivot axis of the lever, the spring acting on the lever such that one of the lever arms holds the locking finger in the locking position via said extension, and the tool having a projection pointing towards the end piece and positioned to encounter and raise the locking finger when the end piece engages in the tool, and said projection having a third ramp on an inner side opposite the locking finger, the end of the locking finger butting against said inner side under the effect of the spring, said locking finger exerting a thrust on the projection in the direction of engagement, actuation of the unlocking jack causing a slight forward movement to be imparted, followed by a slight retraction, of the locking finger, and then causing said finger to rise and disengage from said projection.

9. A device for quick mounting as in claim 8, wherein the third ramp of the projection is a cylindrical surface, having an axis situated above the axis of pivoting of the lever when said lever axis is horizontal, said surface axis being above and in front of the lever axis and the projection.

10. A device for quick mounting as in claim 8, wherein the lever includes two parallel profiled plates connected by spacers, the locking finger being mounted between said plates, and wherein the device comprises two springs acting respectively on each plate, and said jack acting on one of the plate spacers.

11. A device for quick mounting as in claim 8, wherein the spring and the jack are substantially parallel, and wherein the locking means is housed in a protected space of the end piece.

12. A device for rapidly fixing a tool at the end of a construction-machine jib, comprising an end piece intended to be mounted at the end of said jib and provided with two pairs of lateral projections having ramps which become fastened on corresponding ramps of two pairs of corresponding projections formed on opposing faces of two parallel walls of the tool, and locking means for exerting and maintaining an engagement thrust on said projections so as to apply the tool against the end piece and to keep it applied, wherein the locking means comprises a lock mounted so that it can move translationally and rotationally on the end piece on a transverse shaft perpendicular to said parallel walls; a radial end relative to the shaft, of this lock having a profiled side which has an axis that is oblique relative to said shaft; a stop integral with the tool and having a profile whose shape is conjugate with that of the profiled side of the lock and whose axis is parallel to the axis of the profiled side of the lock, the lock becoming engaged, as a wedge, between one side of the end piece and the stop and becoming locked rotationally via its profiled side in the profile of the stop in the locking position; a crank swivelling on the lock; an arm of said crank lock and extends transversely to said shaft; a tension spring acting on the arm of the crank parallel to said shaft and pulling the lock translationally in the direction of the profile of the stop; an end of a hub of the crank being shaped so that it can be driven rotationally by means of a wrench; the hub of the crank having, on its periphery, teeth interacting with a ratchet opposing a rotation of the crank under the effect of said spring; and means for temporarily keeping the lock raised above the stop and separated from its locking position.

13. The device as claimed in claim 12, wherein the profile of the lock and the profile of the stop have a rounded profile.

14. The device as claimed in claim 12, wherein the means for keeping the lock raised and separated from the locking position consist of a ring integral with the lock and of a finger integral with the end piece, on which finger the ring is slipped in the raised and separated position.

15. The device as claimed in claim 12, wherein the locking means is located in the space lying between the end piece and the tool.

16. The device as claimed in claim 12, wherein the lock is mounted on the shaft and this shaft is mounted so that it can rotate and slide in two bearings.

17. The device as claimed in claim 16, wherein a part of the shaft extending beyond one of the bearing has at least one diametral hole in which a removable locking pin is engaged.

* * * * *